US005157267A

United States Patent [19]

Shirata et al.

[11] Patent Number: 5,157,267

[45] Date of Patent: * Oct. 20, 1992

[54] DRIVING APPARATUS FOR STARTING AN ENGINE WITH A STARTER MOTOR ENERGIZED BY A CAPACITOR

[75] Inventors: Akihiro Shirata, Yokohama; Yoshinobu Tsuchiya, Fujisawa; Ken Kurabayashi, Chigasaki, all of Japan

[73] Assignee: Isuzu Motors Limited, Tokyo, Japan

[ * ] Notice: The portion of the term of this patent subsequent to Sep. 8, 2009 has been disclaimed.

[21] Appl. No.: 500,457

[22] Filed: Mar. 28, 1990

[30] Foreign Application Priority Data

Mar. 31, 1989 [JP] Japan ..... 1-082509

[51] Int. Cl.[5] ..... F02N 11/00

[52] U.S. Cl. ..... 290/38 R; 123/179 G

[58] Field of Search ..... 123/179 G; 290/38

[56] References Cited

PUBLICATIONS

J. Kaiser, "Electrical Power Motors Controls, Generators, Transformers" (1982), pp. 145-165.

A. E. Fitzgerald et al. "Electric Machinery" (5th ed. 1990), pp. 488-497.

*Primary Examiner*—A. D. Pellinen

*Assistant Examiner*—Lawrence E. Colbert

*Attorney, Agent, or Firm*—Staas & Halsey

[57] ABSTRACT

An engine starter system for driving an engine starter with electric power from a battery mounted on a motor vehicle has a boost controller for boosting electric power from the battery and a large-capacitance capacitor which is charged by the electric power which is boosted by the boost controller. The engine starter is driven by the electric energy which is stored in the capacitor at a voltage higher than the voltage of the battery.

5 Claims, 2 Drawing Sheets

| POSITION \ CONTACT | B | AC | IG | ST | C |
|---|---|---|---|---|---|
| AC | ○—○ | | | | |
| IG | ○—○—○ | | | | ○ |

MANUALLY PUSHED TO CONNECT CONTACTS B, C

DRIVING APPARATUS FOR STARTING AN ENGINE WITH A STARTER MOTOR ENERGIZED BY A CAPACITOR

BACKGROUND OF THE INVENTION

The present invention relates to an engine starter system for driving an engine starter to start the engine.

Internal combustion engines used as motor vehicle power sources are normally started by a starter motor which comprises a DC series motor. Electric power is supplied from a vehicle-mounted battery to the starter motor, which is energized to cause a pinion gear mounted thereon to rotate a ring gear mounted on the crankshaft and meshing with the pinion gear. Therefore, the crankshaft is rotated to start the engine.

An electric current which is supplied from the battery to the starter motor when starting the engine is very high, e.g., 100 A or more, though it is supplied in a short period of time. Therefore, the electric power consumption by the battery is quite large. The capacity of a battery to be installed on a motor vehicle is determined primarily in view of its ability to start the engine. The large electric power which is consumed to start the engine is supplemented when the battery is charged by electric power generated by an alternator mounted on the motor vehicle and driven by the engine while the motor vehicle is running.

Batteries mounted on motor vehicles are known lead batteries as secondary batteries, and they are charged and discharged through a chemical reaction between electrodes and an electrolytic solution. Such a battery can discharge a large current within a short period of time. The battery is charged with a current of 10 A or less which is supplied over a long period of time and through a gradual chemical reaction. Therefore, if a much larger current is supplied to charge the battery, the battery would be excessively heated and the electrodes might be deformed and damaged.

Motor vehicles which are mainly used by commuters run over short distances, and motor vehicles used as delivery cars are repeatedly stopped and started highly frequently. Since these motor vehicles require the engines to be started frequently and are continuously driven over short periods of time, the batteries mounted on these motor vehicles cannot be charged sufficiently enough to make up for the electric power consumed when the engines are started. Accordingly, the batteries tend to be used up, failing to start the engines.

To solve the above problems, the applicant has proposed a motor vehicle power supply device which has a large-capacity capacitor that is charged by a battery mounted on the motor vehicle and that discharges stored electric energy to actuate the engine starter to start the engine (see U.S. patent application Ser. No. 454,267 and EPC Patent Application No. 89313559.0.

The voltage of a battery does not drop when it is discharged in a short period of time, but the voltage of a capacitor drops greatly when it is discharged. When the lubricating oil of an engine is of high viscosity and the engine is subjected to large friction, at the time the engine is started in cold climate, large electric power has to be supplied to the engine starter to start the engine. At this time, the voltage across the capacitor drops, making it difficult to start the engine. This drawback may be eliminated if the capacitance of the capacitor is increased, but there is a practical limitation on the capacitance of the capacitor.

SUMMARY OF THE INVENTION

It is an object of the present invention to provide an engine starter system which can drive an engine starter in colder conditions and can easily actuate the engine starter even when the capacity of a battery is reduced.

According to the present invention, there is provided an engine starter system comprising a battery, an engine starter for starting an engine with electric power from the battery, boost control means connected to the battery for boosting electric power from the battery, a large-capacitance capacitor connected to the boost control means and chargeable by the boosted electric power from the boost control means, a starter switch connected to the battery parallel to the capacitor, and energizing means for energizing the engine starter with electric energy stored in the capacitor when the starter switch is closed.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
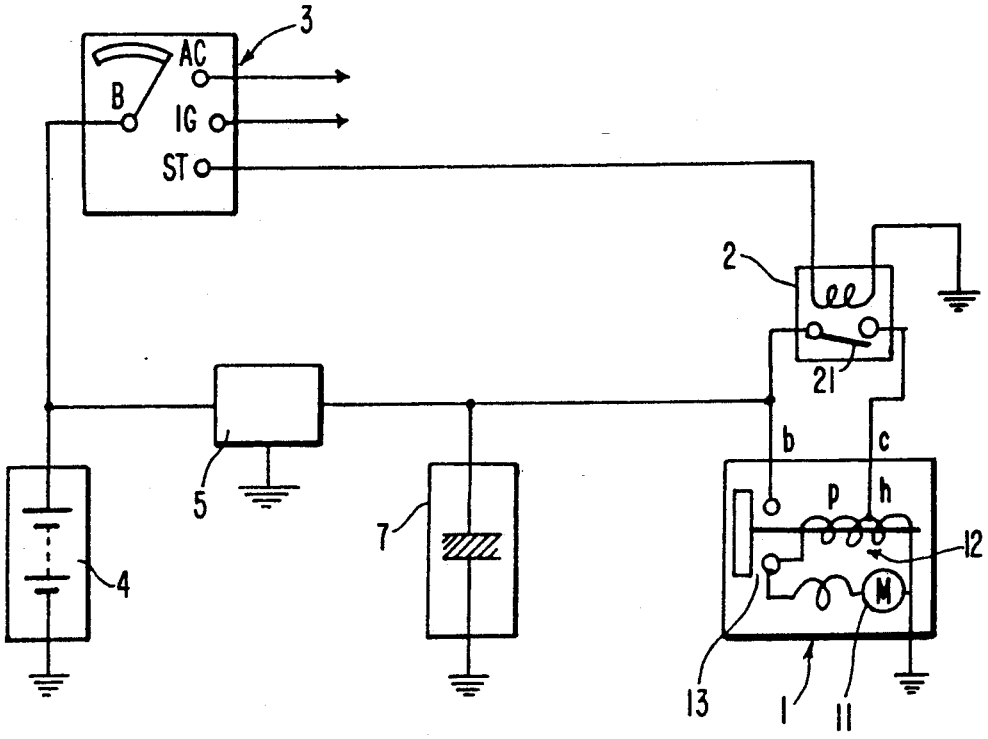
FIG. 1 is a circuit diagram, partly in block form, of an engine starter system according to an embodiment of the present invention.

FIG. 1 shows an engine starter system according to the present invention.

The engine starter system includes an engine starter 1 which comprises a known series motor 11 and a magnet switch 12 having a pull-in coil p and a holding coil h. When a contact 21 of a starter relay 2 is closed and these coils p, h are energized through a terminal c, they magnetically attract a movable contact 13 of the magnet switch 12 to close the contact 13. Then, a large electric current is supplied through a terminal b to the motor 11, which is energized to rotate the crankshaft of an engine (not shown) on a motor vehicle, thereby starting the engine.

A keyswitch 2 supplies electric power from a battery 4 to various parts of the motor vehicle. The key-switch 2 has a switch contact B which is selectively movable to an AC position for supplying the electric power to accessories such as a radio, a car stereo set, etc. while the engine is at rest, an IG position for energizing the ignition unit of the engine, and an ST position for starting the engine.

A boost controller 5, which is connected to the battery 4, includes a switching circuit for converting a DC electric current from the battery 4 into a pulsating current, a boost transformer for increasing the voltage of the pulsating current, and a rectifying circuit for converting the pulsating current into a direct current having a certain high voltage such as of 14 V if the voltage of the battery 4 is 12 V.

A large-capacitance capacitor 7, which is typically a electric double layer capacitor used as a backup power supply for a memory in an electronic device, has an electrostatic capacitance of 100 F (farad). The capacitor 7 has a positive terminal connected to the positive terminal of the boost controller 5, and a negative terminal connected to ground, i.e., the negative terminal of the boost controller 5.

The engine starter system thus constructed operates as follows:

The current from the battery 4 is supplied to the boost controller 5 which then increases the voltage of the battery 4 from 12 V to 14 V. The capacitor 7 is charged with the increased voltage.

Then, the contact B of the keyswitch 3 is shifted to the ST position. The current from the battery 4 is supplied to the starter relay 2, thereby closing the contact 21 thereof. Therefore, the current from the capacitor 7 is supplied to the coils p, h of the starter 1, which are energized to close the contact 13 of the magnet switch 12.

The electric energy charged in the capacitor 7 is supplied as large electric power to the motor 11 to energize the same, rotating the crankshaft to start the engine.

In the above embodiment, the voltage of the electric power from the battery 4 is increased to the voltage which 2 V higher than the battery voltage by the boost controller 5, and then is applied to charge the large-capacitance capacitor 7, and the starter 1 is operated by the electric energy stored in the capacitor 7 to start the engine. Even if the starter is under a high load in cold climate or the amount of electric power stored in the battery 4 is not large enough to directly enable the starter to start the engine, the engine can sufficiently be started with the remaining electric energy from the battery 4.

Figure 2:
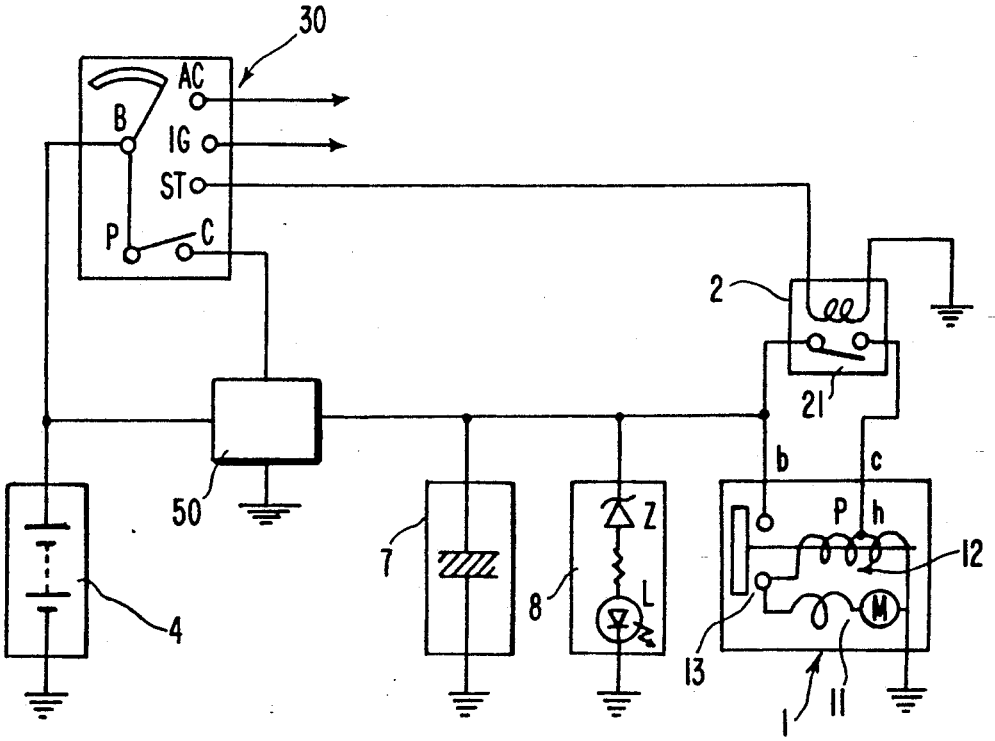
FIG. 2 is a circuit diagram, partly in block form, of an engine starter system according to another embodiment of the present invention.

FIG. 2 shows a engine starter system according to another embodiment of the present invention. Those parts shown in FIG. 2 which ar identical to those shown in FIG. 1 are denoted by identical reference numerals, and will not be described in detail.

A starter 1 and a starter relay 2 shown in FIG. 2 are identical to those shown in FIG. 1.

Figures 3, 4:
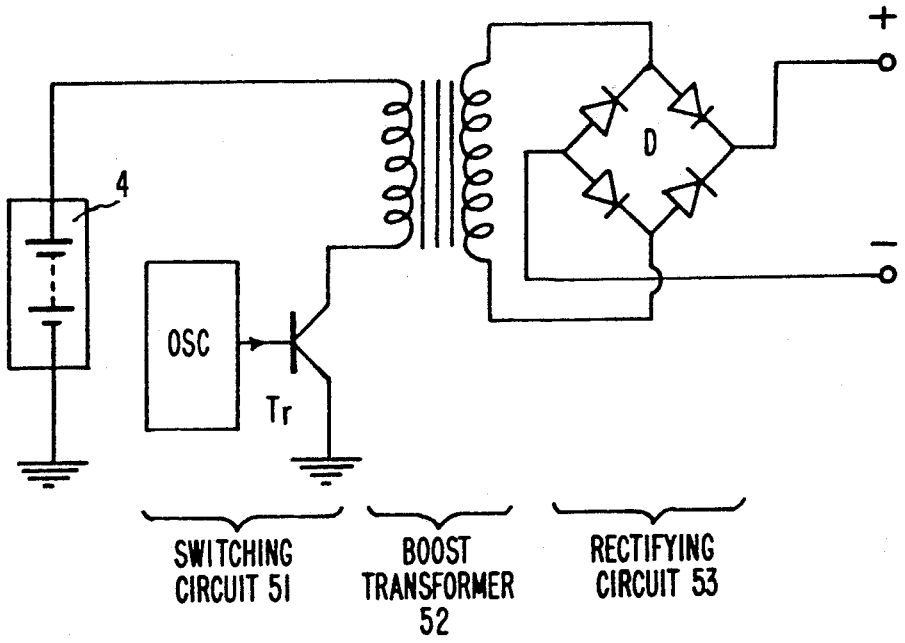
FIG. 3 is a table showing combinations of connected contacts in certain contact positions of a keyswitch used in the engine starter system shown in FIG. 2.
FIG. 4 is a circuit diagram, partly in block form, of a boost controller which is used in the engine starter system of the present invention.

A keyswitch 30 has, as with the keyswitch 3 shown in FIG. 1, a switch contact B which is selectively movable to an AC position for supplying the electric power to accessories such as a radio, a car stereo set, etc., an IG position for energizing the ignition unit of the engine, and an ST position for starting the engine. The keyswitch 30 also has a manually operable switch contact P which is connected to the switch contact B and, when manually pushed, is moved into contact with a contact C to energize a boost controller 50. FIG. 3 shows combinations of connected contacts of the keyswitch 30 in the AC and IG positions.

The boost controller 50, which is connected to the battery 4, includes a switching circuit for converting a DC electric current from the battery 4 into a pulsating current, a boost transformer for increasing the voltage of the pulsating current, and a rectifying circuit for converting the pulsating current into a direct current having a certain high voltage such as of 14 V if the voltage of the battery 4 is 12 V. The boosting operation of the boost controller 50 is controlled by an energization command from the contact C which is closed by the switch contact P. The relay 2 is connected such that the contact 21 of the relay 2 is controlled through the boost controller 50 by the command from the contact C.

FIG. 4 shows a circuit arrangement of the boost controller 50 by wa of example. The boost controller 50 comprises a switching circuit 51, a boost transformer 52, and a rectifying circuit 53. The current supplied from the battery through the primary winding of the boost transformer 52 is converted into a pulsating current by switching operation of a power transistor Tr which is energized by pulses from an oscillating circuit OSC. The voltage of the pulsating current is increased by the secondary winding of the boost transformer 52, and then the pulsating current is converted into a direct current by a diode bridge D of the rectifying circuit 53.

The turn ratio of the boost transformer 52 is selected such that, if the battery has a terminal voltage of 12 V, then the rectifying circuit 53 produces an output voltage of 14 V.

A large-capacitance capacitor 7 shown in FIG. 2 has a positive terminal connected to the positive terminal of the boost controller 50, and a negative terminal connected to ground, i.e., the negative terminal of the boost controller 50.

When the switch contact P of the keyswitch 3 is connected to the contact C to energize the boost controller 50, the voltage across the capacitor 7 is increased to a voltage of 14 V by the boost controller 50 upon elapse of a certain period of time.

A boost indicator 8 detects and indicates the voltage across the capacitor 8. The boost indicator 8 has a light-emitting diode L and a zener diode Z. The zener voltage of the zener diode Z is set to 14 V. Therefore, when the voltage across the capacitor 7 goes higher than the zener voltage, the zener diode Z is rendered conductive to supply a current to the light-emitting diode L, which is energized to indicate that the capacitor 7 is sufficiently charged.

Operation of the engine starter system shown in FIG. 2 is as follows:

Before the engine is started, the switch contact P of the keyswitch 30 is pushed to supply the current from the battery 4 through the contact C to the boost controller 50. The current from the battery 4 is supplied to the boost transformer 52, and the switching circuit 51 operates to supply a pulsating current to the primary winding of the boost transformer 52. A voltage higher than the voltage across the primary winding is induced across the secondary winding of the boost transformer 52, and the current from the secondary winding is converted into a direct current by the rectifying circuit 53, whereupon the capacitor 7 connected to the boost controller 50 starts being charged. After elapse of a prescribed period of time, the voltage across the capacitor 7 reaches the zener voltage of the zener diode Z of the boost indicator 8. The light-emitting diode L is now energized to indicate that the capacitor 7 is sufficiently charged.

Then, the switch contact B of the keyswitch 30 is shifted to the ST position to supply the current from the battery 4 to the starter relay 2, thus closing the contact 21. Therefore, the current from the capacitor 7 is supplied to energize the coils p, h of the starter 1, so that the contact 13 of the magnet switch 12 is closed.

The electric energy charged in the capacitor 7 is supplied as large electric power to the motor 11 to energize the same, rotating the crankshaft to start the engine.

In this embodiment, the keyswitch 30 additionaly has a pushbutton switch contact P. Prior to starting the engine, the switch contact P is pushed into contact with the contact C to energize the boost controller 50, which boosts the battery voltage. The large-capacitance capacitor 7 is therefore charged with the increased voltage. While the capacitor 7 is always charged in the embodiment shown in FIG. 1, the capacitor 7 shown in FIG. 2 is prevented from being discharged naturally of its own accord.

Although certain preferred embodiments have been shown and described, it should be understood that many changes and modifications may be made therein without departing from the scope of the appended claims.

What is claimed is:

1. A driving apparatus supplying electric power to a starter motor coupled to a crankshaft of an engine mounted on a motor vehicle for driving the starter motor, and starting the engine with the starter motor, said driving apparatus comprising:

a battery;

an engine starter for starting an engine with electric power from said battery;

boost control means connected to said battery for boosting electric power from said battery;

a large-capacitance capacitor connected to said boost control mean sand chargeable by the boosted electric power from said boost control means;

a starter switch connected to said battery parallel to said capacitor; and energizing means for energizing said engine starter with electric energy stored in said capacitor when said starter switch is closed.

2. A driving apparatus according to claim 1, wherein said capacitor comprises an electric double layer capacitor.

3. A driving apparatus according to claim 1, wherein said boost control means comprises:

a boost transformer for increasing the voltage of the electric power from said battery;

a switching circuit for converting a current from said battery into a pulsating current flowing through said boost transformer; and a rectifying circuit for rectifying the pulsating current whose voltage is increased by said boost transformer.

4. A driving apparatus according to claim 1, wherein said starter switch includes a manually operable switch contact for energizing said boost control means.

5. A driving apparatus according to claim 1, further comprising voltage indicator means connected to said capacitor, for detecting and indicating the voltage across said capacitor.

* * * * *

UNITED STATES PATENT AND TRADEMARK OFFICE

CERTIFICATE OF CORRECTION

PATENT NO. : 5,157,267

DATED : OCTOBER 20, 1992

INVENTOR(S) : AKIHIRO SHIRATA ET AL.

It is certified that error appears in the above-identified patent and that said Letters Patent is hereby corrected as shown below:

On title page: [56] References Cited, between lines 1 and 2 insert the following:

--U.S. PATENT DOCUMENTS 4,467,748 8/1984 Watanabe .... 123/179G--.

Col. 3, line 5, "a" (last occurrence) should be --an--.

Col. 4, line 8, "wa" should be --way--.

Col. 6, line 4, "mean sand" should be --means and--.

Signed and Sealed this

Twenty-sixth Day of October, 1993

*Attest:*

Bruce Lehman

BRUCE LEHMAN

*Attesting Officer*

*Commissioner of Patents and Trademarks*